US005316353A

United States Patent [19]

McKernan

[11] Patent Number: 5,316,353

[45] Date of Patent: May 31, 1994

[54] SLEEVE FOR DEAD BOLT

[76] Inventor: John L. McKernan, 32 Province St., Boston, Mass. 02108

[21] Appl. No.: 782,974

[22] Filed: Oct. 24, 1991

Related U.S. Application Data

[63] Continuation of Ser. No. 547,380, Jul. 2, 1990, abandoned, which is a continuation of Ser. No. 217,319, Jul. 11, 1988, abandoned.

[51] Int. Cl.[5] ..... E05B 9/00

[52] U.S. Cl. ..... 292/337; 70/416; 70/417; 70/448

[58] Field of Search ..... 70/416–418, 70/448, 451; 292/142, 337

[56] References Cited

U.S. PATENT DOCUMENTS

| | | | |
|---|---|---|---|
| 188,308 | 3/1877 | Sherman | 70/143 |
| 1,126,113 | 1/1915 | Sparks | 292/142 |
| 1,480,650 | 1/1924 | Bacon | 70/418 |
| 2,250,036 | 7/1941 | Schlage | 292/169.13 X |
| 2,765,187 | 10/1956 | Crandell | 292/1 |
| 3,513,674 | 5/1970 | Rutherford | 292/337 |
| 4,139,999 | 2/1979 | Allenbaugh | 70/448 X |
| 4,272,974 | 6/1981 | Hennessy | 70/451 X |
| 4,338,804 | 7/1982 | Solovieff | 292/337 X |
| 4,372,594 | 2/1983 | Gater | 292/337 |
| 4,594,864 | 6/1986 | Hart | 70/474 X |
| 4,602,490 | 7/1986 | Glass et al. | 70/134 |
| 4,940,269 | 7/1990 | Kim | 292/337 |

FOREIGN PATENT DOCUMENTS

| | | | |
|---|---|---|---|
| 1185500 | 1/1965 | Fed. Rep. of Germany | 70/451 |
| 1274771 | 9/1961 | France | 292/142 |
| 322103 | 11/1929 | United Kingdom | 70/416 |
| 2137688 | 10/1984 | United Kingdom | 292/142 |

*Primary Examiner*—Lloyd A. Gall

*Attorney, Agent, or Firm*—Samuels, Gauthier & Stevens

[57] ABSTRACT

A structure is provided to prevent access to the latch pin of a dead bolt or latch lock. For dead bolts, a sleeve is provided which is received over the bolt frame in which the latch pin reciprocates. The sleeve is secured to the frame in such a manner that the latch pin cannot be accessed without removing the sleeve. For latch locks, a sleeve is provided with an extending tongue, which tongue covers the ears of the latch pin and denies access to the ears.

11 Claims, 3 Drawing Sheets

SLEEVE FOR DEAD BOLT

This application is a continuation of Ser. No. 547,380, filed Jul. 2, 1990 (now abandoned) which application was a continuation of Ser. No. 217,319 filed Jul. 11, 1988 (now abandoned.

FIELD OF THE INVENTION

The invention relates to structures which make dead bolt locks and latch lock sets tamper proof.

BACKGROUND AND BRIEF SUMMARY OF THE INVENTION

Various devices have been described to prevent compromise of lock systems. See for example, U.S. Pat. No. 2,785,565; U.S. Pat. No. 4,073,172; U.S. Pat. No. 4,397,168; and U.S. Pat. No. 4,522,048.

Dead bolt locks typically include a latch pin which extends through an arm which arm is joined to the bolt. The latch pin drives the bolt between its extended and retracted positions when a key is turned. If the latch pin is exposed it may be engaged by a pick and the pick can then move the latch to retract the bolt.

It has been discovered that almost all commercially available dead bolts, which have an upper exposed latch pin, and almost all commercially available latch bolt lock sets can be compromised without defacing or injuring the lock itself. A hole is drilled into the door to provide a passageway between the outside of the door to the upper portion of the dead bolt where the pin is or to that portion of the latch lock where the ears are located. A pick is inserted into the hole and the lock can be opened.

Applicant's invention, in one aspect, is directed to structures adapted to be secured to existing lock sets to prevent such a compromise.

The invention, in one aspect, is a sleeve adapted to engage a bolt frame. The sleeve when so engaged encases the latch pin which drives the bolt and thereby denies access to the latch pin from a location exterior to the bolt. In another aspect, the invention comprises the sleeve in combination with a dead bolt assembly.

The invention in still another aspect comprises a hollow cylindrical sleeve with a tongue extending from one end thereof. The sleeve is adapted to be engaged to the cylinder of a latch lock assembly. The tongue is spaced apart from and extends over the ears of the assembly. This sleeve prevents access to the ears from a location exterior to the lock assembly. The invention, in a still further aspect, comprises the cylindrical sleeve in combination with a latch lock assembly.

In a still further aspect of the invention, a dead bolt lock assembly is provided wherein an arm which extends from the bolt has its under surface configured to engage the latch pin.

DESCRIPTION OF THE PREFERRED EMBODIMENT

Figure 1:
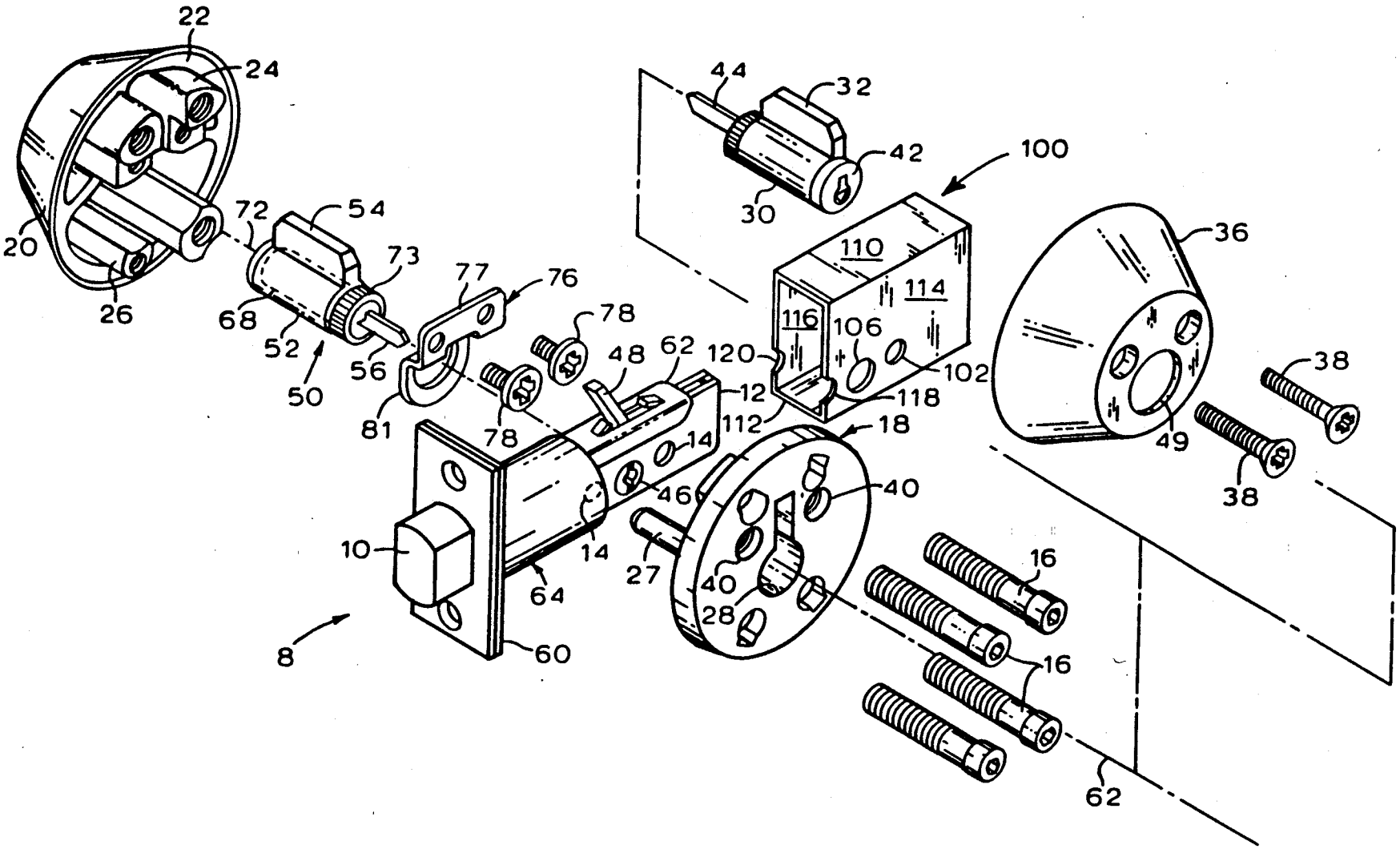
FIG. 1 is a telescopic perspective view of a dead bolt lock assembly embodying the invention.

Referring to FIG. 1, a dead bolt-sleeve assembly is shown. A bolt 10 is adapted to operate between a retracted position (not shown) and an extended position (shown) in which the bolt is projected to engage with a strike box (not shown) in a door frame or wall. The door panel is provided with a through bore in which the dead bolt lock assembly 8 is mounted. The lock mechanism may be controlled by both an exterior key and an interior key. In some instances, the inside face of the lock will be operable not by a key but simply by thumb turn structure as is well known. An example of such a dead bolt is shown in U.S. Pat. No. 4,073,172.

The bolt assembly includes a bolt frame 12 having a pair of holes 14 therein through which pass elongated posts 27 extending from an interior plate 18 adapted to abut against the interior surface of a door panel. A rearwardly extending arm 62 slides on the upper portion of the frame 12.

An exterior shell 20 is formed with an abutting face 22 to contact the exterior surface of the door panel. The shell has a number of pairs of projecting bosses 24 and 26, an envelope contour matching the bore and positioned to receive the fastening bolts 16. The interior plate 18 is formed with a central deep key hole shaped recess and aperture 28 designed to accommodate a standard cylinder body 30 such as customarily found in a key operated pin tumbler cylinder lock mechanism.

The cylinder body 30 has a generally circular cylindrical portion with a radially and axially extending rib or flag 32 thereon. The body 30 fits well within the key hole shaped aperture 28 with the flag and the recess so that the lock mechanism is thereby held against rotation within the plate 18.

The plate 18 and its accompanying mechanism are concealed behind a conical cover 36 secured in place by a pair of screws 38 passing through apertures in the cover and engaging suitably tapped holes 40 in the plate 18. A key operates a rotary plug 42 in the lock mechanism. The plug has the customary axially extending key way and is also joined to a driver bar 44 which is received in a bolt actuating hub 46. A latch pin 48 is joined to the hub 46.

The interior of the shell 20 is provided with a recess so as to snuggly receive a lock unit 50 of a customary kind including a generally circular cylindrical or tubular body 52 and in an upstanding radial and axial flag or rib 54. A driver bar 56 extends from the cylinder and is seated in the bolt actuated hub 46 in the usual way.

The bolt assembly comprises a mortice plate 60, the bolt 10 which includes the rearwardly extending slotted arm 62, a hollow support cylinder 64, and the bolt frame 12 which includes the bolt hub 46 and the latch pin 48. The bolt 10 and arm 62 travel in the hollow support cylinder 64 in a conventional manner.

When one of the cylinders is rotating by actuation of the key element, the latch pin 48 also rotates which converts the rotational movement of the cylinder to the linear motion of the bolt 10.

A rectangular sleeve 100 is received, preferably in frictional engagement, over and encases the bolt frame 12. The sleeve includes paired holes 102 which register with the rearward set of holes 14. Also, holes 106 are in register with the bolt hub 46. The sleeve includes upper and lower walls 110 and 112 and side walls 114 and 116. The upper wall 110 is spaced apart from the upper surface of the bolt mechanism 12 a sufficient distance to allow free movement of the latch pin. The leading edges of the walls 114 and 116 are characterized by recesses 118 and 120. When the entire assembly is secured in place, the recesses 118 and 120 engage the forward locator post 27. The holes 106 have a larger diameter than the bolt hub such that if the sides 114 and 116 engage the sides of the bolt frame 12 they will not interfere with the rotation of the hub. The lower rearward bolt 16 passes through the holes 102. The bottom wall may be eliminated if desired although structurally it strengthens the sleeve.

Figure 2:
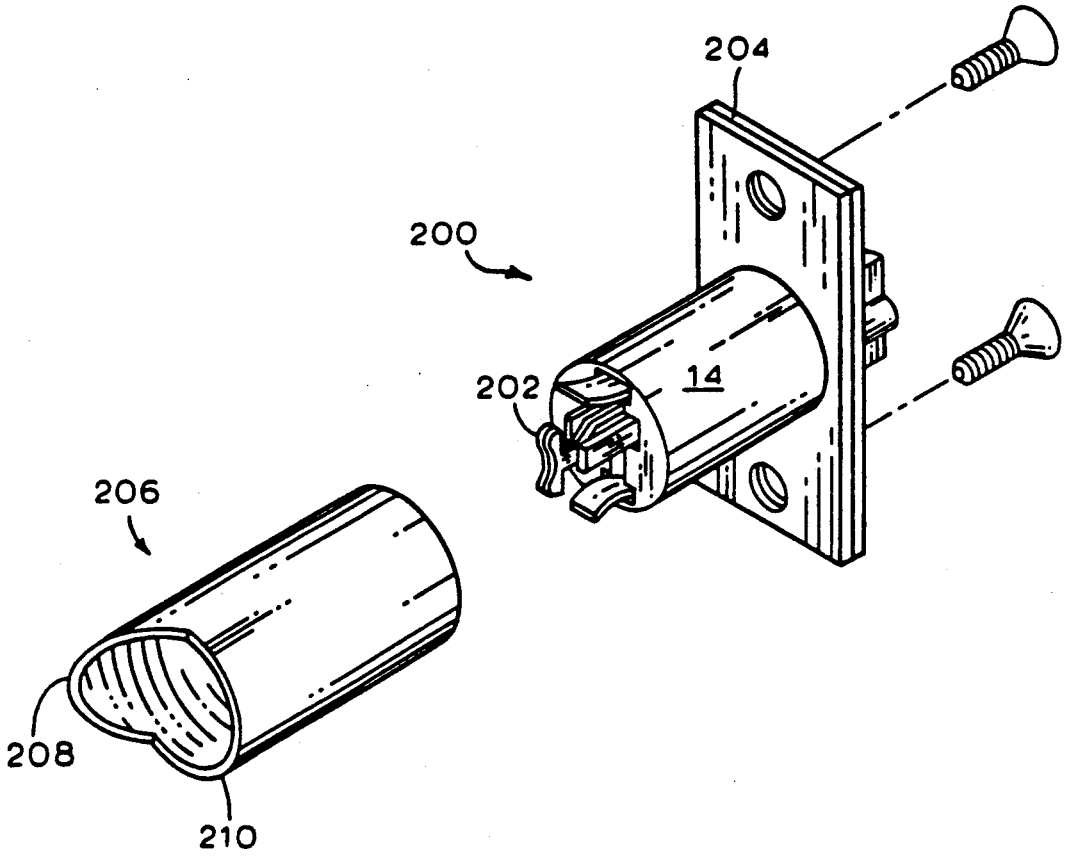
FIG. 2 is a telescopic perspective view or latch lock assembly of an alternative embodiment.

Referring to FIG. 2, a latch lock assembly 200 is shown. A conventional latch lock comprises a housing provided with knob spindles extending therefrom and door knobs for rotating such spindles to actuate retractor mechanisms or ears 202. These locks are usually provided with only one latch bolt and the barrel is relatively small. A front plate 204 is conveniently mortised into the door edge.

This type of lock once installed may be easily compromised by drilling a hole diagonally into the area where the ears are. With the simple insertion of an ice pick or slightly bowed thin metal rod, the ears may be directly engaged and the latch moved rearwardly. This results in a compromise of the lock whereby access may be easily gained.

A sleeve 206 encases such a lock. If an attempt is made to compromise the lock by the method just described, the drill will deflect off or the tip will burn trying to pass through the metal. The sleeve 206 is a hollow cylinder and has a tongue 208 extending from one end 210. The tongue 208 is semi-circular, although it may assume other geometric configurations, and lies in the same plane as the wall from which it extends. The sleeve encloses the barrel in frictional engagement. The tongue 208 shields the ears and is located facing the outer side of the door. It may also be secured by fasteners, adhesives, etc.

Figure 3:
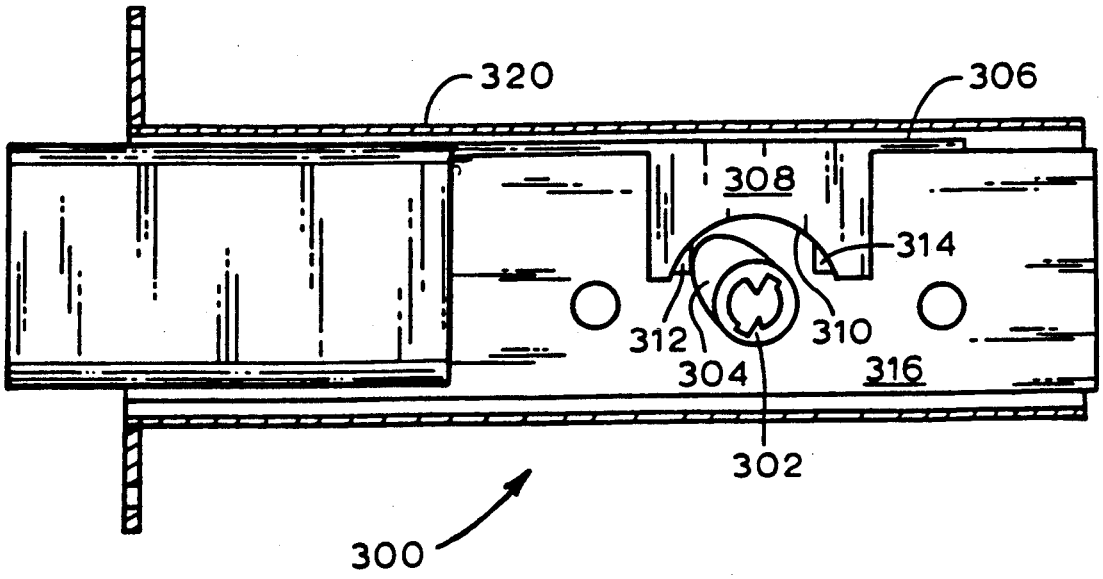
FIG. 3 is a side view of a further embodiment of the invention.
Figure 4:
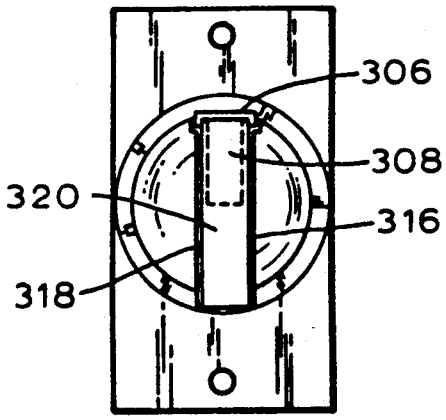
FIG. 4 is a back view of FIG. 3.

Referring to FIG. 3, a bolt assembly 300 is shown which is a modified standard dead bolt. The hub 302 is modified to a pawl shape with the extending portion 304 functioning as a latch pin. The rearwardly extending arm 306 of the bolt is solid not slotted and includes a depending portion 308 terminating in a bottom concave surface 310 having two stops 312 and 314 formed thereon. That is, in a standard dead bolt, the bolt hub and latch pin reciprocate between the two walls of the bolt frame arm. The arm which drives the bolt slides on the upper edges of the walls. In the present invention, the arm 306 includes depending portion 308 which is received between the two walls 316 and 318 of the bolt frame. The arm 306 extends over and rides on the upper edges of the walls 316 and 318. The extending portion of the hub engages this surface and with a camming action opens and closes the bolt when the key is inserted. In this manner, the latch pin is not exposed if the lock is attempted to be compromised in the manner described above. A further modification to existing dead bolts is that the support cylinder 320 is extended to encase the entire sliding arm 306 with the inclusion of the necessary holes for the hub bolt and positioning posts. As shown in FIG. 4, there is a rear wall 320 secured between the walls 316 and 318 which effectively seals or completely denies access to the pin 304.

Whereas the present invention has been described in particular relation to the drawings attached hereto, it should be understood that other and further modifications, apart from those shown or suggested herein may be made within the spirit and scope of this invention.

Having described my invention, what I now claim is:

1. A sleeve having a tongue extending from one end thereof, the sleeve being tubular, the sleeve configured to enclose a barrel of a latch lock, the lock including ears, the tongue spaced apart from and configured to shield the ears of the latch to thereby deny access to the ears from a location exterior of the lock.

2. The sleeve of claim 1 wherein the tongue lies in substantially the same plane as the sleeve wall from which is extends.

3. A protective sleeve adapted to be secured within a dead bolt assembly, the assembly having a bolt frame a bolt actuating hub and a latch pin, the sleeve spaced apart from and extending over the latch pin, which sleeve comprises:

an upper wall having upper and lower smooth surfaces, the upper wall having a pair of outer edges;

a side wall having inner and outer planar surfaces free of recesses, the side wall having upper and lower edges, the upper edge of the side wall joined to one of the outer edges of the upper wall, the upper wall spaced apart from the latch pin a sufficient distance to allow the latch pin to reciprocate, the upper wall in combination with the side wall dimensioned to be received over the bolt frame of the dead bolt assembly and the latch pin, the side wall including means to secure the sleeve within the bolt assembly.

4. The sleeve of claim 3 wherein the means to secure the sleeve within the dead bolt assembly comprises a first aperture formed in the side wall through which a fastener passes to secure the sleeve therein.

5. The sleeve of claim 4 which includes:

second apertures which are in register with the bolt actuating hub.

6. The sleeve of claim 5 wherein the second apertures are of a diameter larger than the diameter of the bolt actuating hub.

7. The sleeve of claim 4 wherein the side wall is a first side wall and wherein the sleeve comprises a second side wall spaced apart from and in parallel relationship with the first side wall, said second side wall having inner and outer planar surfaces.

8. The sleeve of claim 7 wherein the walls include first paired apertures which are in register for the passage of threaded fasteners therethrough and the walls comprise paired second apertures which are in register with the bolt actuating hub.

9. The sleeve of claim 7 wherein the side walls each have a leading edge and recesses are formed in the leading edges of said side walls.

10. The sleeve of claim 7 wherein the side walls are substantially rectangular in shape.

11. The sleeve of claim 7 which includes:

a bottom wall joined to at least one of said side walls.

* * * * *